US008646118B2

(12) United States Patent
Butter-Jentsch et al.

(10) Patent No.: US 8,646,118 B2
(45) Date of Patent: Feb. 11, 2014

(54) CARTRIDGE FOR A TOILET FRESHENER

(75) Inventors: Ralph Butter-Jentsch, Langenfeld (DE); Hans-Georg Muehlhausen, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 309 days.

(21) Appl. No.: 13/025,542

(22) Filed: Feb. 11, 2011

(65) Prior Publication Data

US 2011/0197347 A1 Aug. 18, 2011

Related U.S. Application Data

(63) Continuation of application No. PCT/EP2009/052747, filed on Mar. 10, 2009.

(30) Foreign Application Priority Data

Aug. 14, 2008 (DE) ..... 10 2008 037 724

(51) Int. Cl.
*E03D 9/02* (2006.01)

(52) U.S. Cl.
USPC ..... 4/222; 220/500; 220/501; 215/6

(58) Field of Classification Search
USPC ..... 4/229–231, 223–227.1; 220/501, 500, 220/23.8; 215/10, 6
See application file for complete search history.

(56) References Cited

U.S. PATENT DOCUMENTS

| | | | | | |
|---|---|---|---|---|---|
| 3,994,408 | A | * | 11/1976 | Belitzky | 215/10 |
| 4,455,692 | A | * | 6/1984 | Hegge et al. | 4/227.1 |
| 4,670,916 | A | * | 6/1987 | Bloom | 4/231 |
| 5,551,095 | A | * | 9/1996 | Chen | 4/227.3 |
| 6,003,161 | A | * | 12/1999 | Tomaini | 4/415 |
| D421,289 | S | * | 2/2000 | De Winter | D23/208 |

(Continued)

FOREIGN PATENT DOCUMENTS

| | | | |
|---|---|---|---|
| DE | 102007011991 | A1 | 9/2008 |
| EP | 0785315 | A1 | 7/1997 |

(Continued)

*Primary Examiner* — Gregory Huson
*Assistant Examiner* — Janie Christiansen
(74) *Attorney, Agent, or Firm* — David LeCroy

(57) ABSTRACT

Cartridge (1) for coupling to a toilet flusher comprising at least one chamber (2) for receiving at least one free-flowing toilet cleaning preparation (6). The chamber (2) has an outlet (4) that lies in the direction of gravitation such that the toilet cleaning preparation can be released from the chamber (2) due to the force of gravity. The outlet (4) is, prior to a first coupling to the toilet flusher, secured prior to the release of the toilet cleaning preparation (6). The preparation is released from the cartridge (1) through the outlet due to the force of gravity when the cartridge (1) is first coupled to the toilet flusher. The chamber (2) has a communicating bar (8), wherein the bar and at least one other chamber (10) are designed so that they interact whereby the chamber (10) can be arranged on or next to the bar (8).

19 Claims, 9 Drawing Sheets

(56) References Cited

U.S. PATENT DOCUMENTS

| | | | | |
|---|---|---|---|---|
| 7,039,960 | B2 * | 5/2006 | Pagani | 4/231 |
| 7,234,175 | B2 * | 6/2007 | Wilson et al. | 4/231 |
| 7,721,358 | B2 * | 5/2010 | Park et al. | 4/228.1 |
| 8,015,629 | B2 * | 9/2011 | Nguyen et al. | 4/227.1 |
| 8,201,699 | B2 * | 6/2012 | Zummo et al. | 215/10 |
| 2004/0068782 | A1 | 4/2004 | Butter-Jentsch et al. | |
| 2004/0199985 | A1 | 10/2004 | Wilson et al. | |
| 2009/0077727 | A1 * | 3/2009 | Virica | 4/227.1 |
| 2010/0005578 | A1 | 1/2010 | Pessel et al. | |
| 2010/0192291 | A1 * | 8/2010 | Burt et al. | 4/223 |

FOREIGN PATENT DOCUMENTS

| | | | |
|---|---|---|---|
| EP | 0960984 | A2 | 1/1999 |
| EP | 1469131 | A1 | 10/2004 |
| WO | 2005093176 | A1 | 10/2005 |
| WO | 2006005410 | A1 | 1/2006 |

* cited by examiner

CARTRIDGE FOR A TOILET FRESHENER

CROSS REFERENCE TO RELATED APPLICATIONS

This application is a continuation of International Patent Application No. PCT/EP2009/052747 filed 10 Mar. 2009, which claims priority to German Patent Application No. 10 2008 037 724.4 filed 14 Aug. 2008, both of which are incorporated herein by reference.

The present invention relates to a cartridge for a toilet freshener and to a method for the production thereof.

Many different toilet fresheners for toilet bowls are known from the prior art. For example, there are toilet fresheners for active substance preparations wherein the active substances are dissolved out of a solid matrix. Such solid active substance preparations are also known as rim blocks.

Active substance preparations in gel form and liquid form are also known. These toilet fresheners contain at least one liquid, flowable, active substance preparation. Toilet fresheners for an individual active substance preparation are firstly known. The preparation is typically located in a reservoir fixedly arranged in or a cartridge interchangeably inserted into a holder. The cartridge can take the form of a refill solution that, once used, may be removed from the toilet freshener and replaced by a new, full cartridge.

Toilet fresheners can be fastened to the toilet rim with a clip formed on the holder, the storage vessel or release means provided therefor (e.g., flush plates) so that they lay in the interior of the toilet immediately beneath the toilet rim. When flushing water emerges from under the interior toilet rim, the flushing water flows over the reservoir or the corresponding release devices. Such toilet fresheners are known, for example, from EP 1 334 239 B1.

In a first toilet freshener known from EP 785 315 A1 for a single active substance fluid, the active substance fluid is added via an actuating element saturable therewith (e.g., made from an open-pored foam) which may be exposed to the flushing liquid. In this case, after a cartridge closing part has been pushed out, the outlet orifice of the cartridge is largely closed by a sealing element fixedly arranged on the holder so that only a flow path with a small cross-section remains available for discharging the active substance fluid. The device functions by exploiting the capillary action of the open-pored foam. A similar design with a ribbed plate for distribution purposes is also known.

When using toilet freshener of this type, all the components which enter the flushing liquid of the toilet bowl must be present together in the active substance fluid. However, many active ingredient components cannot be formulated together in storage-stable manner. In this regard, a multi-chamber toilet freshener has already been proposed (EP 0 960 984 A2). This toilet freshener serves to release at least two different or identical solid, gel, pasty or liquid media in liquid or aqueous form into a toilet bowl. The separation of chambers in the container has the advantage that different media may be used which, if stored together in only one chamber, would otherwise have a harmful influence with regard to their desired actions. The consistency of the media in the different chambers may also be different.

A feature common to these active substance preparations is that they typically contain one or more scents.

One substantial disadvantage of such toilet fresheners has long been that fragrancing of the toilet bowl or of the environment surrounding the toilet bowl is substantially coupled with the toilet flushing process, since such toilet fresheners are constructed in such a manner that a perfume-containing active substance is conventionally released only from the above-described toilet fresheners when flushing water flows over the toilet freshener.

The odor impression is therefore intermittent and usually of only short duration. In particular, toilet fresheners of the above-stated type do not provide fragrancing before or for a relatively long period after use of a toilet.

This disadvantage led to the development of toilet release systems that permit permanent release of a scent into the surrounding environment of a toilet bowl. WO 2005/093176, for example, discloses a toilet freshener into the housing of which a gel-form block containing scent is firmly cast. A drawback to this solution is that the gel-form block is arranged so that flushing water flows over it, thereby gradually dissolving it, as a result of which an extremely unattractive visual appearance gradually develops.

This problem is avoided, for example, by a toilet freshener according to WO2006/005410. In this toilet freshener, scent-containing chambers are arranged on the holder of the release device. Enclosing the scent preparation in a chamber prevents unintentional release of the preparation by dissolution brought about by flushing water. Furthermore, using a chamber makes it possible to use liquids as the scent carrier, which can have higher scent concentrations.

There is accordingly a need for cartridges that accommodate flowable preparations for coupling with toilet fresheners, which may be produced inexpensively and on which an additional, preferably scent emitting, chamber can be arranged.

The present invention provides cartridges for accommodating flowable preparations for coupling with toilet fresheners, which may be produced inexpensively and on which an additional chamber can be arranged.

This is achieved by a cartridge for coupling with a toilet freshener having at least one chamber for accommodating at least one flowable toilet cleaning preparation. The chamber has an outlet orifice located in the direction of gravity so that gravity-actuated release of the toilet cleaning preparation from the chamber is enabled. Prior to first coupling with the toilet freshener, the outlet orifice is secured against leakage of the toilet cleaning preparation and gravity-actuated release from the cartridge through the outlet orifice is effected on first coupling of the cartridge with the toilet freshener. The chamber has a communicating web, wherein the web and at least one further chamber are constructed and interact in such a manner so that the further chamber can be arranged on or against the web.

This is further achieved by a cartridge for coupling with a toilet freshener, the cartridge having a first chamber for accommodating at least one first flowable toilet cleaning preparation, and at least one second chamber for accommodating a second preparation. Each chambers has an outlet orifice located in the direction of gravity whereby gravity-actuated release of the toilet cleaning preparation from at least the first chamber is enabled. Prior to first coupling with the toilet freshener, the outlet orifices are secured against leakage of the toilet cleaning preparation and gravity-actuated release from the cartridge through the outlet orifice is enabled on first coupling of the cartridge with the toilet freshener. The first chamber and the at least one second chamber are connected to one another via a non-communicating web, wherein at least one further chamber is constructed and interacts in such a manner so that the further chamber may be arranged on or against the web.

This is also achieved by a cartridge production method for producing a cartridge as described above for detachable coupling with a toilet freshener. The method involves producing a tube of a heated, formable plastics material by a continuous or discontinuous extrusion process. The extruded tube is enclosed with a blowing mold having at least one first and one second blowing mandrel which are introduced into the tube to form the outlet orifices of the cartridge. Compressed air is blown through the mandrels into the tube, thereby pressing the tube against the internal, shape-imparting contour of the blowing mold. A web is pinched off between the first and second outlet orifices of the cartridge on closing the blowing mold and optionally stamping out the fastener. A further chamber can be mounted onto the web.

TOILET FRESHENER

Figure 1:
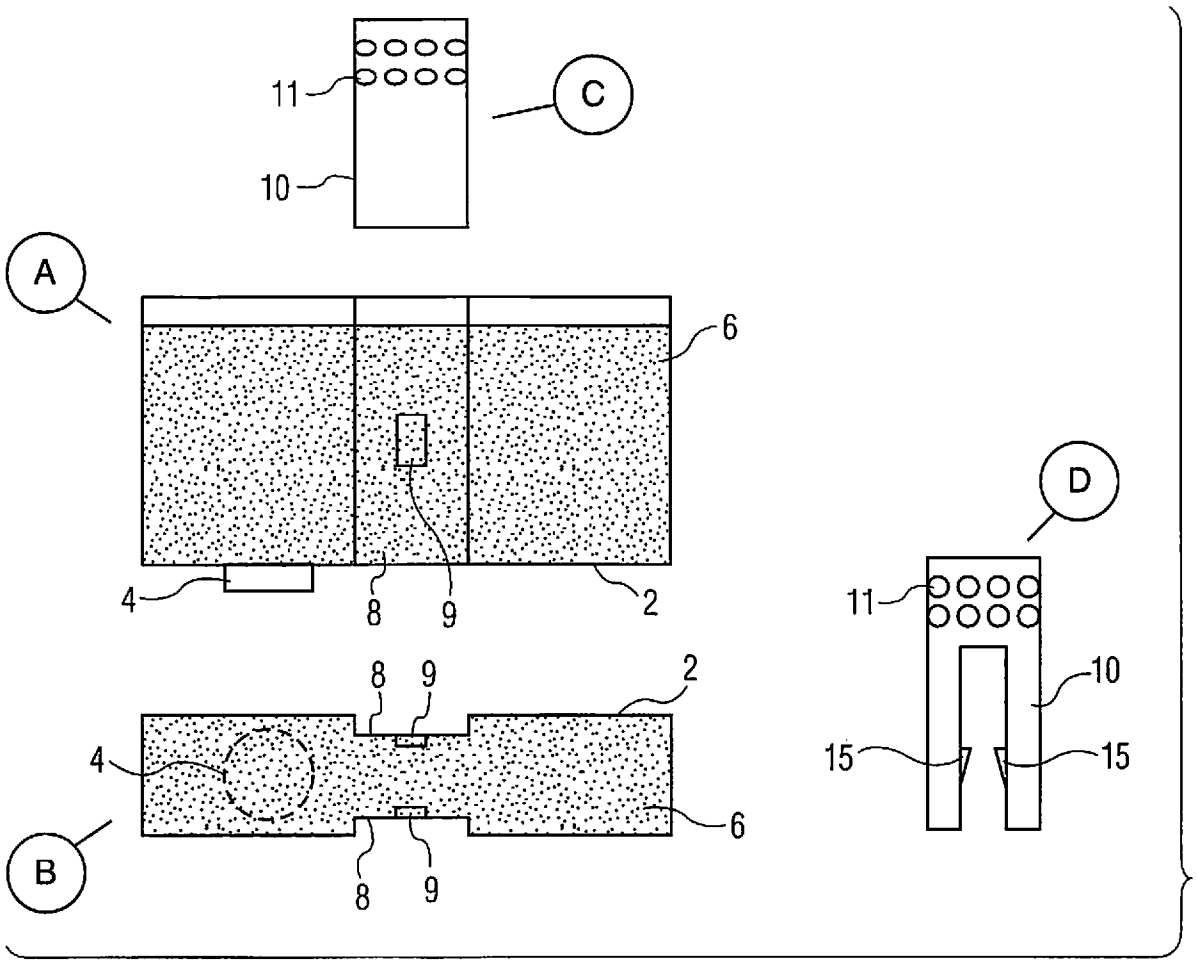
FIG. 1 is an illustration of a single chamber cartridge with communicating web illustrating a front elevation view (A) of the single chamber 2 cartridge, top plan view (B) of the single chamber 2 cartridge 2, front elevation view (C) of a further chamber 10, and side elevation view (D) of the further chamber 10.

The cartridge according to the invention is particularly suitable for storing flowable toilet cleaning preparations and for coupling with a toilet freshener.

The toilet freshener includes a device which prevents free flow of toilet cleaning preparation so that, when coupled with the cartridge, no toilet cleaning preparation can freely leak from the toilet freshener.

The device which prevents free flow of toilet cleaning preparation is connected in communicating manner with an impingement element, whereby toilet cleaning preparation may pass from the cartridge via the interposed device preventing free flow of active substance fluid onto the impingement element.

The toilet freshener includes an impingement element which, when the toilet freshener is fitted on the rim of the toilet bowl, can extend into the flushing water stream so that toilet cleaning preparation is released by the impingement element into the flushing water stream.

Cartridge

The cartridge according to the invention for coupling with a toilet freshener may be constructed as a single chamber or multichamber container As a single chamber cartridge, the cartridge includes a chamber containing a toilet cleaning preparation with a communicating web, wherein the web and at least one further chamber are constructed and interact in such a manner with the web that the further chamber may be arranged on or against the web.

In an alternative embodiment, the cartridge is configured as a multichamber variant, wherein the first chamber and second chamber are connected with one another via a non-communicating web, in which at least one further chamber is constructed and interacts with the web in such a manner that the further chamber can be arranged on or against the web.

In an advantageous further embodiment of the invention, the web is materially bonded with the first and the second chamber. This can be achieved by adhesive and/or welded connections. It is also preferred to form the web during the cartridge molding process, for example, in an extrusion blowing method, in materially bonded manner, for example, by pinching off. It is also conceivable for the web to be connected interlockingly and/or frictionally with the chambers.

In a preferred embodiment of the invention, the web is a single-part construction with the first chamber and the second chamber. This can be achieved by correspondingly pinching off the web in a blow molding method. The advantage of this embodiment is that such a cartridge may be produced inexpensively in a single process step.

It is therefore preferred to form the single chamber or multichamber cartridge according to the invention by a blow molding technique.

The cartridge can also be configured for detachable coupling with the toilet freshener. This makes it possible to remove used cartridges from the toilet freshener and to couple a filled cartridge with the toilet freshener.

Chamber

The cartridge according to the invention includes a further chamber which may be arranged on or against the web.

The further chamber can be arranged on the web by interlocking, friction and/or bonding.

Preferably, the further chamber has a fastener which interacts with a fastener arranged on the web so that, in the assembled state of the further chamber and web, an interlocking and/or frictional connection is formed.

It is particularly preferred that the further chamber has a fastener which interacts with a fastener arranged on the web so that, in the assembled state of further chamber and web, a snap-fit or latching connection is formed. The fastener arranged on the web preferably takes the form of an orifice.

In a further embodiment of the invention, the further chamber may contain a preparation which differs from the preparation of the first chamber and/or, if present, from the preparation of the second chamber.

In particular, the further chamber may be constructed for accommodating and continuously releasing a scent.

According to a further, preferred embodiment, the further chamber is configured for accommodating a flowable toilet cleaning preparation wherein the further chamber has an outlet orifice located in the direction of gravity, enabling gravity-actuated release of the toilet cleaning preparation from the further chamber. Prior to first coupling with the toilet freshener, the outlet orifice is secured against leakage of the toilet cleaning preparation, and gravity-actuated release from the cartridge through the outlet orifice is enabled on first coupling of the cartridge with the toilet freshener.

Toilet Cleaning Preparation

For the purpose of this application, toilet cleaning preparations are compositions having at least one substance from the group of cleaning agents and/or scents.

Suitable toilet cleaning preparations include scent phases, particularly perfumed scent phases. Such scent phases conventionally contain at least one scent, preferably a perfume oil, at least one surfactant or emulsifier, and water. It can optionally contain further ingredients such as preservatives, thickeners, complexing agents, dyes, further surfactants, or emulsifiers, stabilizers, limescale removers, etc.

According to a preferred embodiment of the invention, the preparations include substances for modifying surfaces, particularly ceramic surfaces.

Preparations also suitable according to the invention are bleach phases, particularly chlorine-containing bleach phases, preferably bleach phases based on hypochlorite, wherein, in addition to the actual bleaching agent and water, the bleach phases can optionally contain further ingredients such as thickeners, surfactants or emulsifiers, neutralizing agents, dyes, scents, etc.

Further toilet cleaning preparations suitable according to the invention are limescale removing active substance phases, preferably acidic limescale removing active substance phases. In addition to the actual limescale remover (which preferably includes an organic or inorganic acid) and water, such limescale removing active substance phases may optionally contain further ingredients such as surfactants or emulsifiers, thickeners, scents, preservatives, etc.

It is likewise possible to use highly concentrated surfactant phases, or "foam boosters", as toilet cleaning preparations. In addition to surfactants, such highly concentrated surfactant phases may also contain conventional ingredients. Such foam boosters are in particular advantageous for pretreating the toilet bowl with a carpet of foam, for example, in order to prevent or reduce adhesion of excreted metabolites to the surface of the toilet and/or to trap malodors.

Toilet cleaning preparations with an antibacterial and/or fungicidal and/or antiviral active substance phase are likewise suitable according to the invention, wherein in addition to the antibacterial and/or fungicidal and/or antiviral active substance and water, the active substance phase may optionally contain further ingredients, such as for example surfactants or emulsifiers, thickeners, scents, preservatives, etc.

It is furthermore possible for the toilet cleaning preparations to be enzyme-containing active substance phases. In addition to enzyme(s) and water, such enzyme-containing active substance phases may optionally contain further ingredients such as surfactants or emulsifiers, thickeners, scents, preservatives, etc.

It is likewise possible for the toilet cleaning preparations used according to the invention to be absorbent, in particular odor-absorbing active substance phases. In addition to the absorbent, particularly an odor absorbent, and water, these phases may optionally contain further ingredients such as surfactants or emulsifiers, thickeners, scents, preservatives, etc.

The cartridge according to the invention offers the possibility of using combinations of different preparations in the chambers, wherein, according to a preferred embodiment, one of the chambers contains a scent phase.

Examples of useful preparation combinations include a perfumed scent phase together with chlorine bleach (which are not stable when stored together), perfumed scent phase with highly concentrated surfactant phase (foam booster), scent phase with limescale removing, acidic active substance phase, scent phase with antibacterial active substance phase, various acid systems, scent phase combined with enzyme-containing active substance phase, perfumed acid phase combined with water-coloring phase, scent phase with odor-absorbing phase, perfumed acid phase with active oxygen, perfumed acid phase with active substance phase, polyacrylate-thickened, etc.

Production Processes

The multichamber cartridge according to the invention for coupling with a toilet freshener can be manufactured by the production method described below— a) producing a tube of a heated, formable plastics material by a continuous or discontinuous extrusion process,
b) enclosing the extruded tube with a blowing mold having at least one first and one second blowing mandrel which are introduced into the tube to form the outlet orifices of the cartridge and through which compressed air is blown into the tube, so pressing the tube against the internal, shape-imparting contour of the blowing mold,
c) pinching off a web between the first and second outlet orifices of the cartridge on closing the blowing mold, and optionally stamping out the fastening means, and
d) mounting a further chamber on the web.

It is in particular advantageous to blow the cartridge through each orifice. It is furthermore preferred to construct the web as a non-communicating web.

REFERENCE NUMERALS

1. Toilet freshener
2. Chamber
3. Chamber
4. Outlet orifice
5. Outlet orifice
6. Preparation
7. Preparation
8. Web
9. Fastener
10. Chamber
11. Outlet orifice
12. Design element
13. Web
14. Web
15. Fastener FIG. 1 shows detail views (A) and (B) of a single chamber cartridge with a chamber 2 filled with a flowable toilet cleaning substance 6. Detail view (A) provides a front elevation view and detail view (B) a top plan view of the cartridge. The chamber 2 includes an outlet orifice 4 located in the direction of gravity, whereby gravity-actuated release of the toilet cleaning preparation 6 from the chamber 2 is enabled. Prior to first coupling with the toilet freshener, the outlet orifice 4 is secured against leakage of the toilet cleaning preparation 6 and gravity-actuated release from the cartridge through the outlet orifice 4 is enabled on first coupling of the cartridge with the toilet freshener.

The chamber 2 includes a communicating web 8. The web 8 is configured as a zone which narrows in from both longitudinal sides towards the middle of the chamber. Fluid exchange within the chamber is ensured through this zone. The narrowing is preferably rectangular in shape as illustrated in top plan view, but may also assume any other suitable shape.

A fastener 9 is provided in the area of the web. The fastener is constructed as a recess in the web wall. It may be seen from detail view (B) that one recess 9 is arranged on each of the two opposing walls of the web.

Detail views (C) and (D) show a further chamber 10 which is arranged on or against the web 8. Detail view (C) shows the chamber 10 in front elevation view, and detail view (D) in side elevation view. The upper zone of the further chamber 10 has peripheral orifices 11 through which, for example, scents can be released into the surrounding environment of the cartridge. It may be seen from side view (D) that the chamber 10 is U-shaped in construction, thereby making it possible to place the legs of the U-shaped chamber 10 over the web 8. On the inner side of the legs are provided fasteners 15 in the form of ramp-like latching lugs which, when the chamber 10 is placed on the web 8, engage in the recess 9 of the web, thereby securing the chamber 10 onto the web 8.

Figure 2:
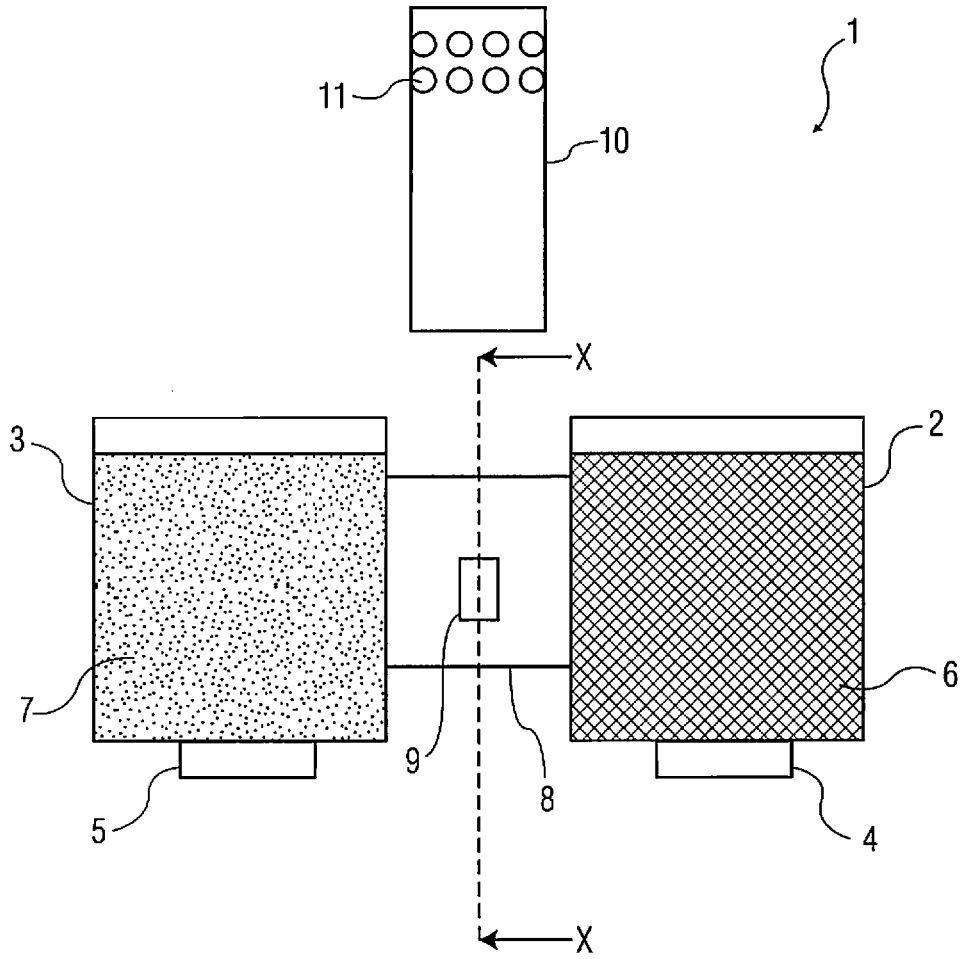
FIG. 2 is an illustration of a two or bichamber cartridge with web and a further chamber in front elevation view.

FIG. 2 shows an example of a bichamber cartridge 1. The cartridge has a first chamber 2 in which a first toilet cleaning preparation 6 is stored, and a second chamber 3 in which a second toilet cleaning preparation 7 is stored. Each chamber 2, 3 has an outlet orifice 4, 5 at the bottom. The two chambers 2, 3 are connected to one another by the web 8. The web 8 is of a length which makes it possible to arrange a further chamber 10 on or against the web between the chambers 2, 3. A fastener 9 constructed as an orifice is provided in the web 8. Interaction of the fastener 9, web 8 and chamber 10 is explained in greater detail below with reference to FIG. 3 and FIG. 4.

Figure 3:
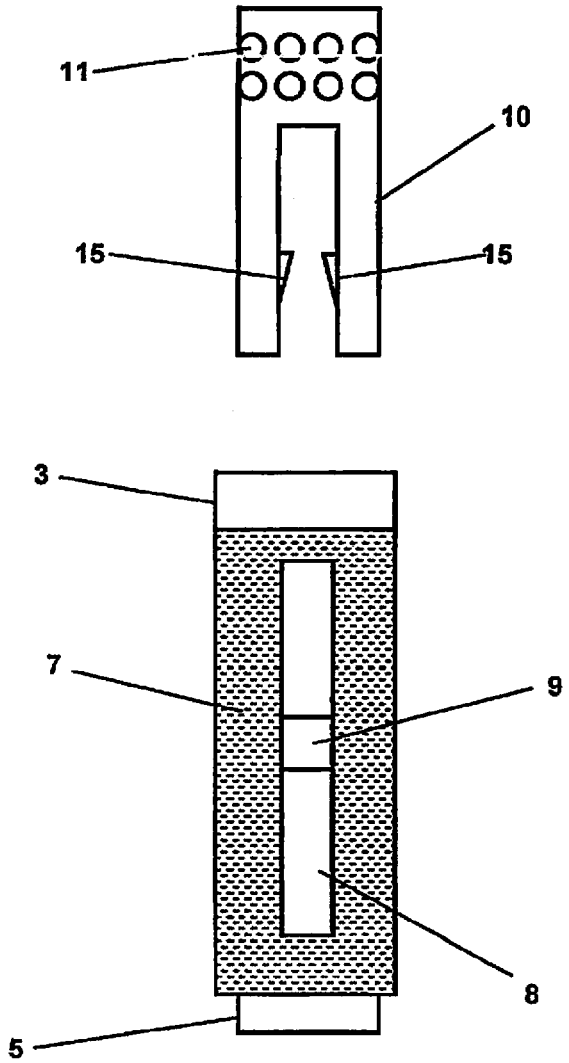
FIG. 3 is an illustration of a bichamber cartridge with web and a further chamber in a side cross-sectional view.

FIG. 3 shows the cartridge 1 illustrated in FIG. 2 in a cross-sectional view corresponding to the section along the axis X-X. The chamber 10 is likewise shown in side view. It can be seen that the chamber 10 is U-shaped, with the distance between the two opposing legs being greater than the width of the web 8, thereby allowing the chambers 10 to be placed over the web 8. It is also conceivable to select the distance between the two opposing legs to be less than the width of the web 8. The chamber 10 can then be shaped so that the legs spread apart, enabling the chamber to be arranged on the web 8. To secure the chamber 10 on the web 8, the chamber 10 has fasteners 15 which form a snap-fit or latching connection with the orifice 9 of the web 8.

Figure 4:
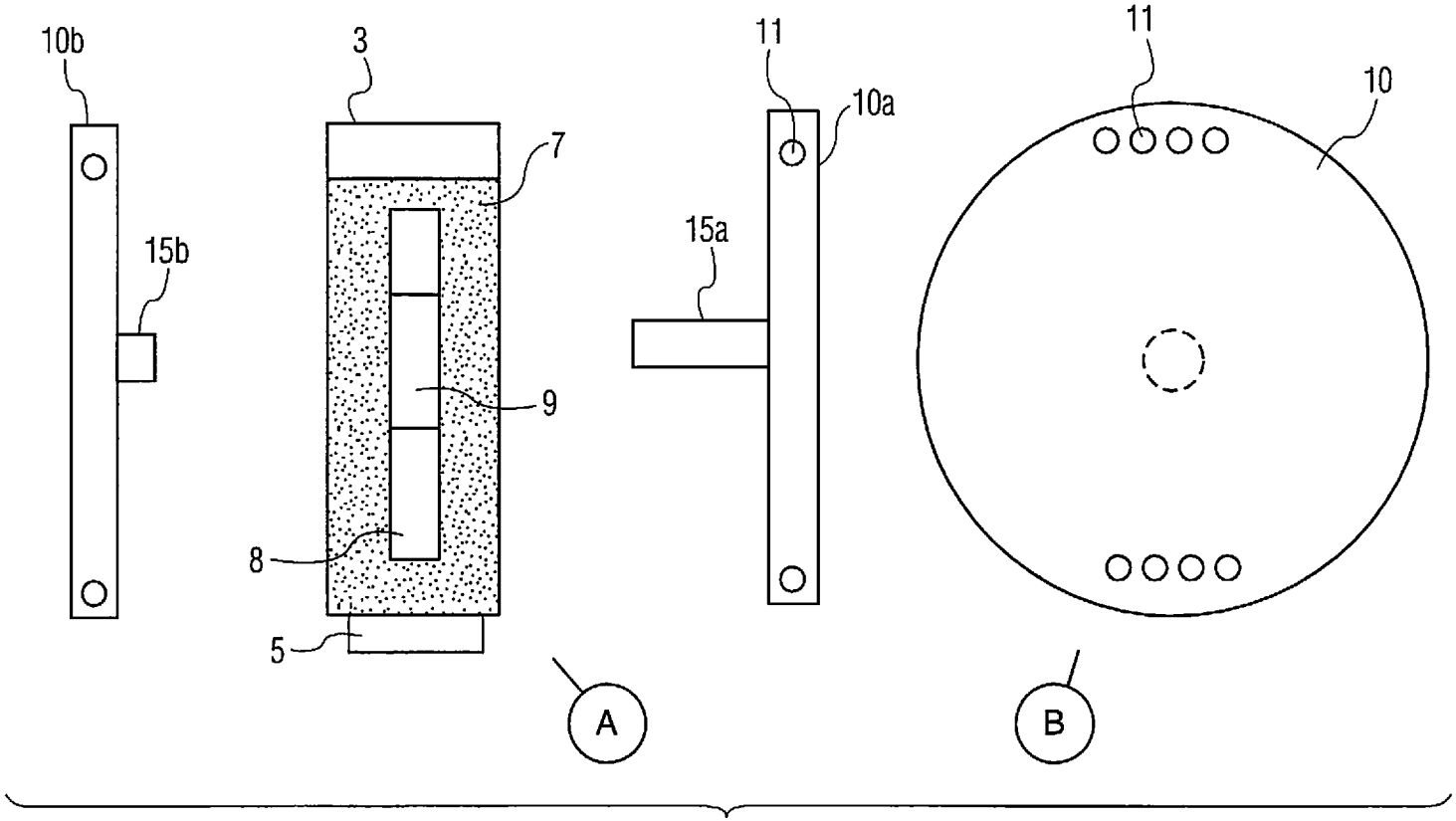
FIG. 4 is an illustration of a bichamber cartridge with web and a two-part, disk-shaped chamber in cross-sectional view (A) and front view of the disk (B).

FIG. 4 shows another option for fastening a chamber 10 to the web 8. Detail view (A) shows the cross-sectional view of the cartridge known from FIG. 3. It can be seen that the chamber 10 has a first chamber element 10*a* and a second chamber element 10*b*, each of which have a cylindrical fastener 15*a*, 15*b* which can pass through the orifice 9 of the web. When assembled, the cylindrical fasteners 15*a*, 15*b* can be secured to one another by a press fit, snap-fit/latching connection or also adhesive bonding.

Detail view (B) shows a front view of the two-part container 10. It can be seen that the container is disk-shaped, the diameter of the container 10 corresponding approximately to the height and/or width of the cartridge. Further three-dimensional shapes of the container are conceivable, as shown by the examples of FIGS. 5-7, which are explained in greater detail below.

Figure 5:
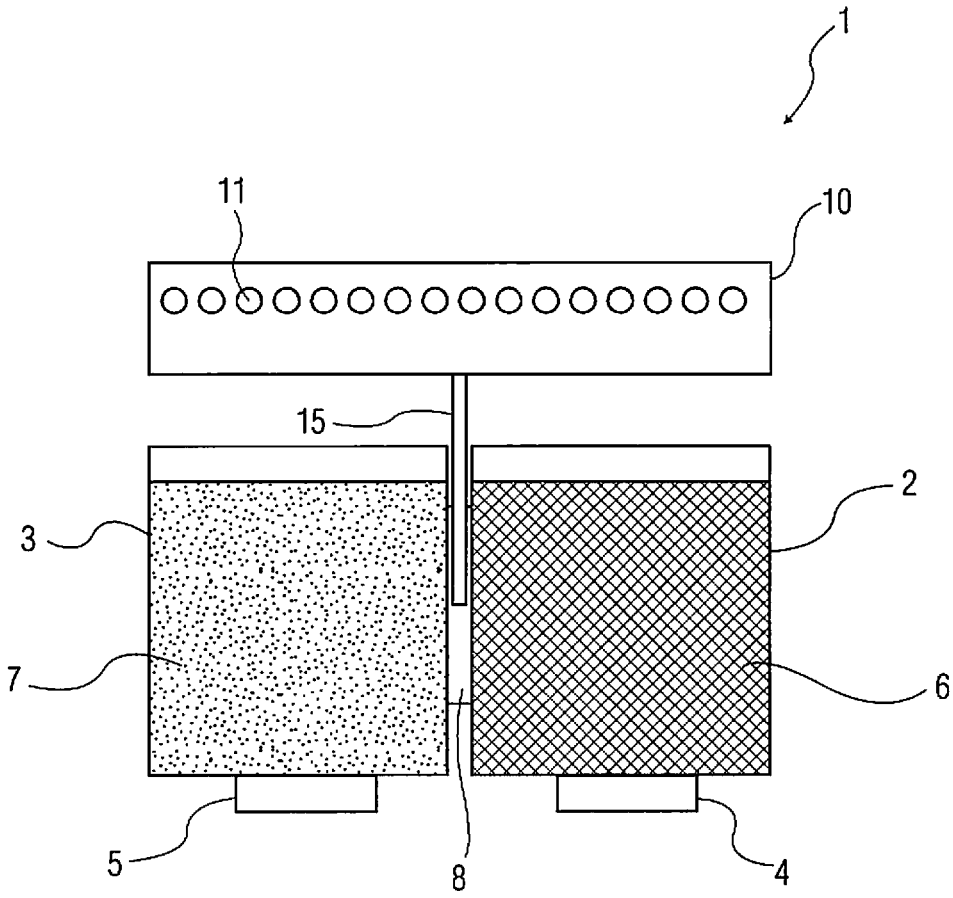
FIG. 5 is a front elevation view of a bichamber cartridge with web and a stick-shaped fastening element.

FIG. 5 shows a chamber 10 which is fastened to the web 8 by a stick-shaped fastener. The chamber 10 is constructed so that, when fastened to the web 8, it rests on the respective tops of the chambers 2, 3. The chamber 10 may, as indicated in FIG. 5, extend over the entire length of cartridge 1.

Figure 6:
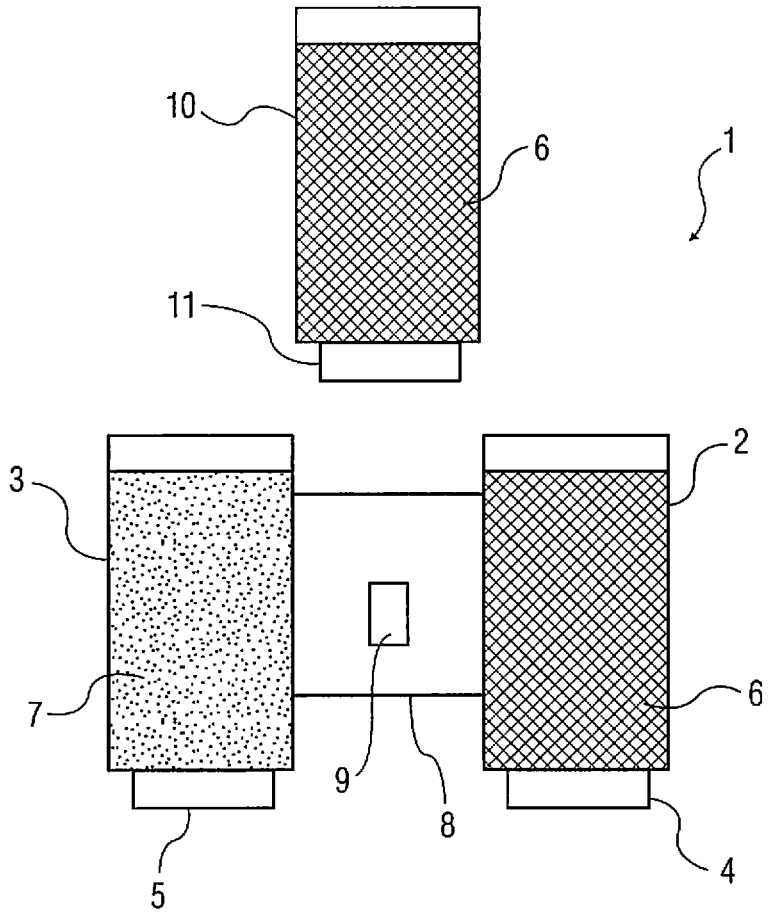
FIG. 6 is an illustration of a bichamber cartridge with web and a further chamber containing toilet cleaning substance.

FIG. 6 shows a further embodiment of the cartridge known from FIG. 2. The chamber 10 here is constructed to accommodate a flowable toilet cleaning preparation 6 and has an outlet orifice 11 at the bottom. Arranging this chamber 10 on or against the web 8 forms a trichamber cartridge which, when coupled with a corresponding toilet freshener, is capable of releasing three, preferably different, toilet cleaning preparations into the flush water of the toilet bowl.

Figure 7:
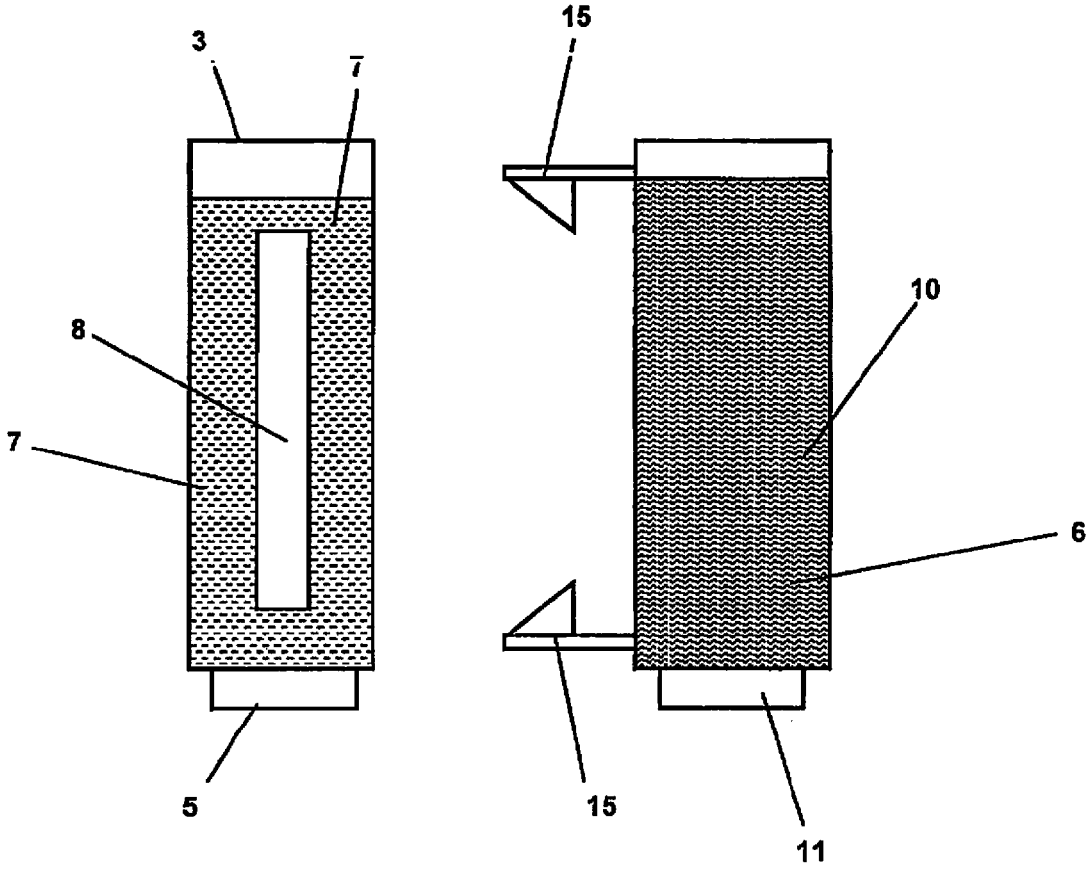
FIG. 7 is an illustration of a bichamber cartridge with web and a further chamber containing toilet cleaning substance in cross-sectional view.

FIG. 7 shows an option for fastening the chamber 10 for such a configuration. The chamber 10 here has as a fastener 15 a clip element with two opposing legs shaped so that they can be spread apart resiliently. The distance between the two legs approximately corresponds to the height of the web 8, so that the chamber 10 can be fastened laterally to the web by a snap-fit connection.

Figure 8:
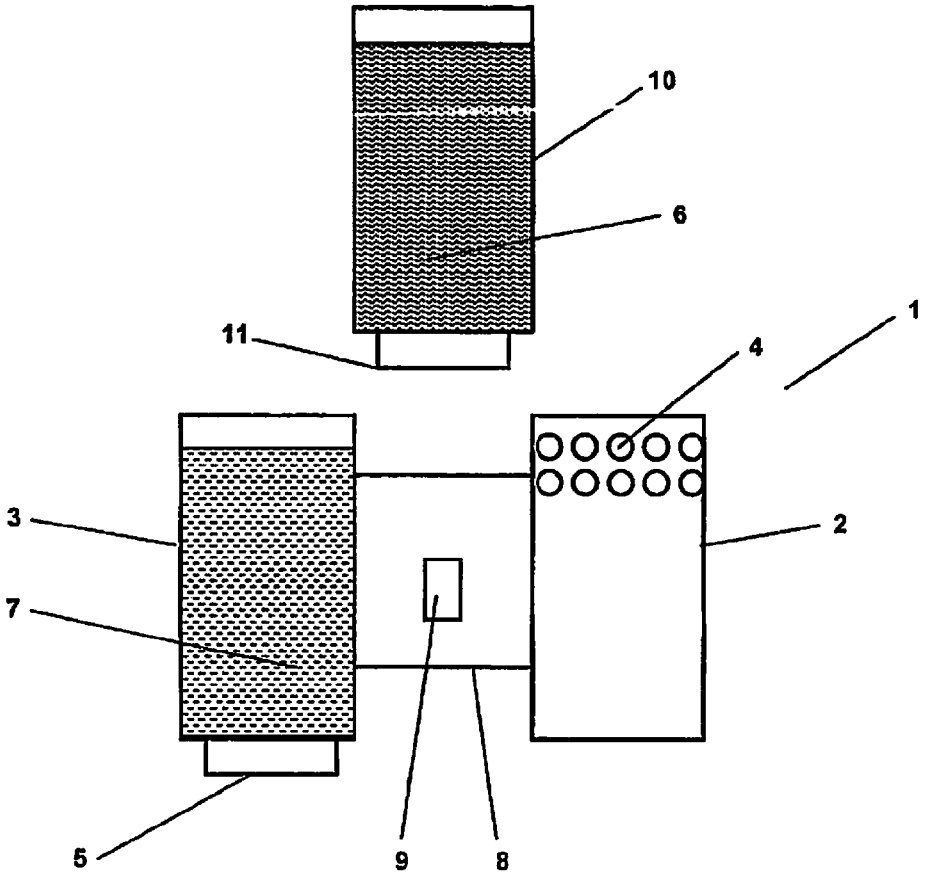
FIG. 8 is an illustration of a bichamber cartridge with a scent chamber and a web and a further chamber containing toilet cleaning substance.
Figure 9:
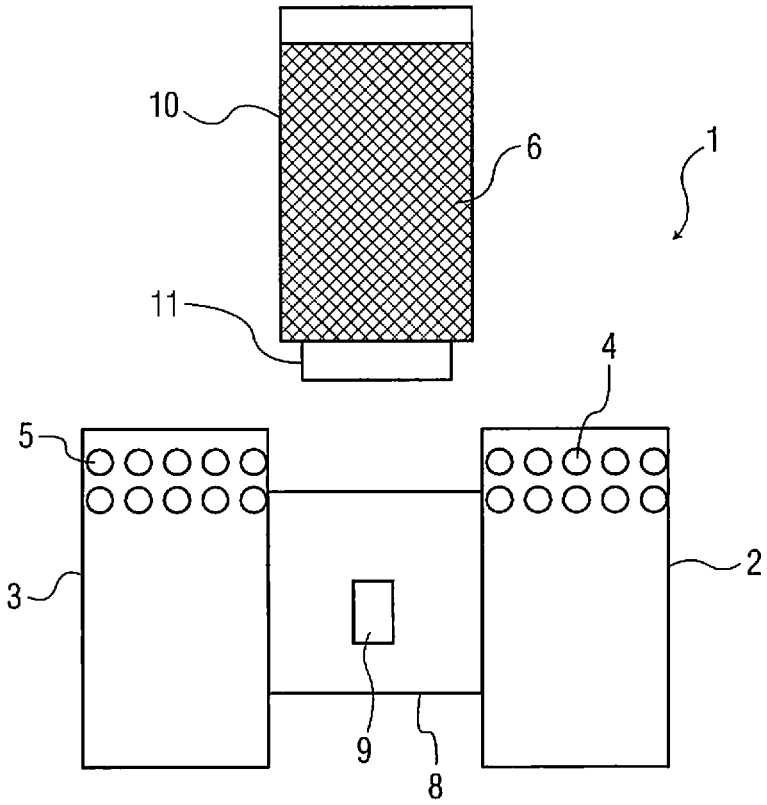
FIG. 9 is an illustration of a bichamber cartridge with two scent chambers and a web and a further chamber containing toilet cleaning substance

Further alternative developments of the cartridge known from FIG. 6 and FIG. 7 are shown in FIGS. 8-9. As seen from FIGS. 8-9, both the first chamber 2 arranged on the web 8 and the second chamber 2 arranged on the web 8 can be closed at the bottom and provided with orifices 4, 5 which permit release of a highly volatile substance, such as a scent, from the chambers 2, 3 into the surrounding environment.

We claim:

1. Cartridge for coupling with a toilet freshener comprising:

at least one first chamber for accommodating at least one flowable toilet cleaning preparation, the at least one chamber having an outlet orifice located in the direction of gravity so that gravity-actuated release of the toilet cleaning preparation from the chamber is effected, wherein, prior to first coupling with the toilet freshener, the outlet orifice is secured against leakage of the toilet cleaning preparation and gravity-actuated release from the cartridge through the outlet orifice is effected on first coupling of the cartridge with the toilet freshener, the chamber further comprising a communicating web which narrows in from both longitudinal sides of the at least one first chamber towards the middle of the chamber and through which the flowable toilet cleaning preparation occurs, the web being of single-part construction with the first chamber, wherein the web and at least one further chamber are constructed and interact in such a manner that the further chamber may be arranged on or against the web.

2. Cartridge according to claim 1, wherein the further chamber is arranged on the web by interlocking, friction and/or bonding.

3. Cartridge according to claim 1, the further chamber further comprising a fastener which interacts with a fastener arranged on the web so that, when the further chamber and web are assembled together, an interlocking and/or frictional connection is formed.

4. Cartridge according to claim 1, the further chamber further comprising a fastener which interacts with a fastener arranged on the web so that, when the further chamber and web are assembled together, a snap-fit or latching connection is formed.

5. Cartridge according to claim 4, wherein the fastener arranged on the web is an orifice.

6. Cartridge according to claim 1, wherein the further chamber has a preparation different from the preparation of the at least one first chamber.

7. Cartridge according to claim 1, wherein the further chamber is constructed for accommodating and continuously releasing a scent.

8. Cartridge according to claim 1, wherein the further chamber is configured for accommodating a flowable toilet cleaning preparation, wherein the further chamber has an outlet orifice located in the direction of gravity, such that gravity-actuated release of the toilet cleaning preparation from the further chamber can be effected, wherein, prior to first coupling with the toilet freshener, the outlet orifice is secured against leakage of the toilet cleaning preparation and gravity-actuated release from the cartridge through the outlet orifice is effected on first coupling of the cartridge with the toilet freshener.

9. Cartridge according to claim 1, wherein the cartridge is a blow molded cartridge.

10. Cartridge according to claim 1, wherein the chamber is dimensionally stable.

11. Cartridge for coupling with a toilet freshener, the toilet freshener comprising:

a first chamber for accommodating a first flowable toilet cleaning preparation, a second chamber for accommodating a second preparation, wherein both chambers have an outlet orifice located in the direction of gravity whereby gravity-actuated release of at least the first preparation from at least the first chamber is effected, wherein, prior to first coupling with the toilet freshener, the outlet orifices are secured against leakage of the toilet cleaning preparations and gravity-actuated release from the cartridge through at least one of the outlet orifices is effected on first coupling of the cartridge with the toilet freshener, wherein the first chamber and the second chamber are connected to one another via a non-communicating web, the web being of single-part construction with the first and second chambers and narrowing in from both longitudinal sides toward the middle between the first and second chambers, and further comprising at least one further chamber, wherein the non-communicating web and at least one further chamber are constructed and interact in such a manner that the further chamber may be arranged on or against the non-communicating web, and wherein the non-communicating web is of a length that allows the further chamber to be arranged on or against the web between the first and second chambers.

12. Cartridge according to claim 11, wherein the further chamber has a preparation different from the preparation of the at least one first chamber and from the preparation of the at least one second chamber.

13. Cartridge according to claim 11, wherein the further chamber is arranged on the web by interlocking, friction and/or bonding.

14. Cartridge according to claim 11, the further chamber further comprising a fastener which interacts with a fastener arranged on the web so that when the further chamber and web are assembled together, an interlocking and/or frictional connection is formed.

15. Cartridge according to claim 11, the further chamber further comprising a fastener which interacts with a fastener arranged on the web so that, when the further chamber and web are assembled together, a snap-fit or latching connection is formed.

16. Cartridge according to claim 15, wherein the fastener arranged on the web is an orifice.

17. Cartridge according to claim 11, wherein the further chamber is constructed for accommodating and continuously releasing a scent.

18. Cartridge according to claim 11, wherein the further chamber is configured for accommodating a flowable toilet cleaning preparation, wherein the further chamber has an outlet orifice located in the direction of gravity, such that gravity-actuated release of the toilet cleaning preparation from the further chamber can be effected, wherein, prior to first coupling with the toilet freshener, the outlet orifice is secured against leakage of the toilet cleaning preparation and gravity-actuated release from the cartridge through the outlet orifice is effected on first coupling of the cartridge with the toilet freshener.

19. Cartridge according to claim 11, wherein the cartridge is a blow molded cartridge.

* * * * *